US005133892A

United States Patent [19]

Chun et al.

[11] Patent Number: 5,133,892

[45] Date of Patent: Jul. 28, 1992

[54] MACHINE DISHWASHING DETERGENT TABLETS

[75] Inventors: Kil W. Chun, Wyckoff; Richard F. Theiler, Harrington Park; Mark I. Baumgarten, Englewood, all of N.J.; Robert Gabriel, Ellicott City

[73] Assignee: Lever Brothers Company, Division of Conopco, Inc., New York, N.Y.

[21] Appl. No.: 599,207

[22] Filed: Oct. 17, 1990

[51] Int. Cl.[5] ..... C11D 17/00; C11D 7/54; C11D 7/18

[52] U.S. Cl. ..... 252/90; 252/91; 252/95; 252/99; 252/174.12; 252/174.13

[58] Field of Search ..... 252/90, 91, 95, 99, 252/174.12, 174.13

[56] References Cited

U.S. PATENT DOCUMENTS

| | | | |
|---|---|---|---|
| Re. 32,763 | 8/1988 | Fernholz et al. | 252/90 |
| Re. 32,818 | 1/1989 | Fernholz et al. | 252/90 |
| 3,318,817 | 5/1967 | Smith . | |
| 3,329,615 | 7/1967 | Cooper et al. . | |
| 3,344,076 | 9/1967 | Wilcox . | |
| 3,390,092 | 6/1968 | Keast et al. . | |
| 3,417,024 | 12/1968 | Goldwasser . | |
| 3,488,420 | 1/1970 | Keast et al. . | |
| 3,962,107 | 6/1976 | Levin et al. . | |
| 4,099,912 | 7/1978 | Ehrlich . | |
| 4,139,589 | 2/1979 | Beringer et al. . | |
| 4,219,435 | 8/1980 | Biard et al. | 252/135 |
| 4,219,436 | 8/1980 | Gromer et al. | 252/174 |
| 4,253,842 | 3/1981 | Ehrlich . | |
| 4,417,993 | 11/1983 | Gergely . | |
| 4,569,780 | 2/1986 | Fernholz et al. | 252/99 |
| 4,569,781 | 2/1986 | Fernholz et al. | 252/99 |
| 4,587,031 | 5/1986 | Kruse et al. . | |
| 4,690,770 | 9/1987 | Jeschke et al. . | |
| 4,725,376 | 2/1988 | Copeland | 252/90 |
| 4,729,845 | 3/1988 | Altenschoepfer et al. | 252/99 |
| 4,741,858 | 5/1988 | Choy et al. | 252/99 |
| 4,828,745 | 5/1989 | Jeschke et al. . | |
| 4,828,749 | 5/1989 | Kruse et al. | 252/135 |
| 4,839,078 | 6/1989 | Kruse et al. . | |
| 4,863,626 | 9/1989 | Coyne et al. | 252/91 |
| 4,865,849 | 9/1989 | Conte et al. | 424/466 |
| 4,913,832 | 4/1990 | Kruse et al. . | |
| 4,965,012 | 10/1990 | Olson | 252/174.12 |

FOREIGN PATENT DOCUMENTS

| | | |
|---|---|---|
| 1346609 | 2/1974 | United Kingdom . |
| 2089830 | 6/1982 | United Kingdom . |

OTHER PUBLICATIONS

SPEX Press Product Brochure.
Drycota and Bicota Product Brochure.

*Primary Examiner*—A. Lionel Clingman
*Assistant Examiner*—William S. Parks
*Attorney, Agent, or Firm*—Rimma Mitelman

[57] ABSTRACT

A multilayer detergent tablet containing an outer layer, a barrier layer and an inner layer. The tablet releases sequentially ingredients contained in the outer layer and ingredients contained in the inner layer. The time interval between the release of the outer layer ingredients and the release of the inner layer ingredients is controlled by the particular choice of an ingredient for the barrier layer and the relative thicknesses of the inner layer, the barrier layer and the outer layer. The tablet is able to separate in time the dissolution of incompatible ingredients such as an enzyme and a chlorine bleach. The tablet also provides sequential release of a dishwashing composition and a rinse aid composition such that cleaning is accomplished prior to the release of the rinse aid.

29 Claims, 5 Drawing Sheets

Effects of Polymer Composition on Dissolution Rate (110 F)

Effects of Polymer Composition on Dissolution Rate (140 F)

Effects of Polymer Composition on Dissolution Rate in Dishwashing Machine

Starch Soil Removal

MACHINE DISHWASHING DETERGENT TABLETS

FIELD OF THE INVENTION

The present invention concerns machine dishwashing detergent tablets. More particularly, the invention relates to machine dishwashing detergent tablets which release various ingredients sequentially. The invention also relates to methods of dishwashing by the use of the tablets.

BACKGROUND OF THE INVENTION

Tablets have been extensively used in a field which is not related to detergent or dishwashing detergent arts, namely, in a field of medicine. In addition to producing uniform tablets, pharmaceutical industry has attempted to solve a problem of incorporating two substances which are incompatible with one another in the same tablet. In some cases, it is desired that a medicinal tablet release the same or different actives at successive times. A tablet for pharmaceutical use which is able to release an active substance at successive times is disclosed by Conte et al., U.S. Pat. No. 4,865,849. The tablet of the Conte et al. patent is said to be particularly suitable in medicinal field but generally usable in all sectors in which active substances have to be released at different times spaced apart by a predetermined time interval such as in the fertilizer, herbicide and other sectors.

The tablet of Conte et al. includes a first layer containing a portion of the active substance and suitable excipients, a barrier layer of polymer material, and a third layer containing the remaining portion of active substance or another active substance. The barrier layer and the third layer are housed in a casing. For the barrier layer, polymers are used which are gellable and/or soluble on contact with water or aqueous fluids. The polymers for the barrier layer of the tablet disclosed by Conte et al. are chosen from cellulose derivatives such as hydroxypropylmethylcellulose, methylcellulose or polyvinylalcohols of various molecular weights. For the casing, water-insoluble materials are preferably used, but in certain embodiments polymers soluble in an alkaline environment can be used to facilitate destruction of the casing when in the enteric tract.

A multistage release pharmaceutical tablet having a structure similar to the tablet disclosed by Conte et al. is described in Great Britain patent application 1,346,609.

The structure of the tablet disclosed by the Conte et al. patent and the '609 reference differs from a structure of a tablet taught by the present invention. In the tablet disclosed by Conte et al. and by the '609 reference, the first and the third layer each contact only one side of a barrier layer. Consequently, all layers of the tablet disclosed by the Conte et al. patent and the 609 reference would be exposed to water simultaneously and the tablet requires an additional, fourth layer which is needed to encase the barrier layer and the third layer. By contrast, in the tablet of the present invention an outer layer encloses a barrier layer on all sides, and the barrier layer, in turn, encloses an inner layer on all sides.

Although the tablet of the Conte et al. patent is said to be suitable for use in fields other than medicinal field, the Conte et al. patent and the '609 reference neither mention dishwashing nor disclose problems of providing sequential release under conditions of machine dishwashing cleaning which include high agitation, high temperature, highly alkaline cleaning environment and a strict time cycle program.

In this regard, it should be noted that while a sequential release is a feature of some medicinal tablets and the dishwashing detergent tablet of the present invention, the chemical composition and physical characteristics of the two tablets are so different, the release time program and the environment of dissolution are so diverse, and the principles and skills required in formulating the two tablets are so distinct, that it is difficult to extend the teachings in one of the arts to the other.

In the dishwashing and detergent arts, cleaning compositions in tablet form have been described, for example, in U.S. Pat. No. 3,318,817 to Smith, in U.S. Pat. No. 3,329,615 to Cooper et al., U.S. Pat. No. 3,344,076 to Wilcox, U.S. Pat. No. 3,417,024 to Goldwasser, U.S. Pat. No. 3,390,092 to Keast et al., U.S. Pat. No. 3,488,420 to Keast et al., U.S. Pat. No. 4,219,435 to Biard et al., U.S. Pat. No. 4,219,436 to Gromer, and U.S. Pat. No. 4,587,031 to Kruse et al., the '092, '435, '436 and '031 patents being directed particularly to dishwashing tablets. It has been disclosed that the use of detergent tablets may be advantageous, since the tablets are nondusting, do not require measuring, take less space because they are compressed, and ingredients of the tablets do not segregate on storage. However, all of the above cited patents disclose tablets which are uniform in composition and there remain dishwashing formulation problems which have not been addressed by these patents. Among the unsolved problems is a problem of incompatibility of various dishwashing detergent ingredients.

For example, it has been found that it is particularly beneficial to include both an enzyme and a chlorine bleach in order to achieve better cleaning of dishware. Unfortunately, enzymes are deactivated in the presence of the chlorine bleach, during storage and in an aqueous cleaning solution formed in a dishwashing machine. Enzyme-containing dishwashing compositions are generally formulated with oxygen bleaches, such as perborate, in place of chlorine. However, it has been found that dish cleaning performance of oxygen bleaches is far inferior to dish cleaning performance of chlorine bleaches. Other examples of incompatible ingredients include surfactants, dyes and perfumes all of which, unless specially selected, are incompatible with chlorine.

Elrich, U.S. Pat. No. 4,099,912 and Elrich, U.S. Pat. No. 4,253,842 disclose that components of detergent compositions can be separately tableted. It is evident that such separately tableted formulations make it necessary for a consumer to purchase a large number of different tablets in order to arrive at a complete effective formulation. Additionally, unless various incompatible components are introduced into a dishwashing machine as separate tablets at successive time intervals (which would be extremely inconvenient), there still exists the problem of deactivation of the incompatible components in an aqueous cleaning environment of a dishwashing machine once the tablets have been dissolved.

U.S. Pat. No. 4,839,078 to Kruse et al. discloses detergent tablets having a uniform composition and a broad solubility profile: at least 10% of the tablet is dissolved in only the prerinse cycle by the cold water flowing in, and at least 65%, preferably at least 70%, by weight of the tablet is available for the main wash cycle due to its good solubility in warm water. The tablet of Kruse et al.

contains alkaline-reacting components such as alkali metal metasilicates and penta-alkali metal triphosphates, active chlorine compounds and tableting aids.

Jeschke et al., U.S. Pat. No. 4,828,745, Kruse et al, U.S. Pat. No. 4,828,749 and Kruse et al., U.S. Pat. No. 4,913,832 disclose multilayer dishwashing tablets which are suitable for simultaneous use in the pre-rinse cycle and in the main wash cycle of dishwashing machines. The '745 patent discloses a block-form detergent which includes two or more differently acting layers fused to each other. The first layer is cold water soluble and the second layer is warm water soluble. The '745 patent mentions that the layer formation disclosed therein may be used for the separation of incompatible components. The '749 patent discloses a multilayer detergent tablet similar to the block-form detergent of the '745 patent. The first layer is cold water soluble and includes a nonionic surfactant. The second layer is warm water soluble and includes an active chlorine compound. The '832 patent discloses a two-layer compact which may contain chlorine and nonionic surfactant provided that they are incorporated into different layers.

A serious shortcoming of the tablets disclosed in the Kruse et al. '078 patent, the Jeschke et al. '745 patent and the Kruse et al. '749 and '832 patents is that during storage incompatible ingredients are still in contact with each other in a border area, where two layers meet. An even more important shortcoming of the tablets disclosed in these patents is that it is not possible to provide a separate release of incompatible ingredients during the same cycle of dishwashing cleaning or during different cycles occurring at the same water temperature: both layers of the tablets are exposed to water simultaneously and, unless water temperature is different, dissolution of both layers occurs at the same time. Thus, if the first layer were to include an enzyme and the second layer were to include a chlorine bleach, the enzyme and the chlorine bleach would be dissolving at the same time. As a result, the enzyme would be deactivated by the chlorine bleach before the enzyme has had time to perform its cleaning function.

Fernholz et al., U.S. Pat. No. 4,569,780 and Fernholz et al., U.S. Pat. No. 4,569,781 describe a process for preparing a solid castdetergent, and a solid cast detergent produced by the process. Fernholz et al. disclose that the cast detergent article can be designed or structured to minimize chlorine stability and differential solubility problems, e.g. by including the chlorine source and/or the defoamer as preformed plugs or cores encased in the cast detergent composition. The cast detergent is surrounded on all but one surface by a disposable mold in which it was formed. To minimize reactivity between the base detergent and any material added as preformed plugs, the core material may be optionally encased in a film which would not react with the core material or the detergent base. The film materials disclosed are a natural wax, a synthetic wax, a phosphate ester, or the like. Examples 4 and 6 of the Fernholz et al. patents are cast detergent articles containing chlorine and/or defoamer plugs and Example 13 describes improved storage stability of the cast detergent articles containing the plugs.

Although storage stability of the cast detergents containing incompatible ingredients disclosed by Fernholz et al. can be achieved by separating the incompatible ingredients, dissolution of the incompatible ingredients is not separated in time. Fernholz et al. disclose that in use water impinges on the exposed surface of the plug material and the detergent base; the base detergent and the plug material dissolve at substantially the same rate so that a constant ratio of components can be maintained during use.

Thus, in formulating automatic dishwashing detergent tablets, it has been necessary to avoid a co-presence of various incompatible ingredients (such as a chlorine bleach and an enzyme) which deactivate each other in use. At best, the ingredients have been selected which are more compatible but not as efficient with regard to performance or cost as desired. It should be emphasized that merely separating incompatible ingredients during storage, albeit important, is not sufficient It is essential that dissolution of the ingredients is separated in time so that during use sufficient time is allowed for one of the ingredients (e.g., enzyme) to perform its function prior to a release of the second ingredient (e.g., chlorine) which deactivates the first one.

In addition to the incompatibility problems, dishwashing tablets which are able to release sequentially components contained therein are needed for other reasons. For example, it has been established that a rinse aid greatly improves appearance of dishes and glasses by decreasing the amount of spotting and filming and improving the shining of dishes and glasses. Heretofore, it has been necessary to introduce the rinse aid in a dishwashing machine separately from a dishwashing detergent, which is inconvenient and requires a separate purchase by a consumer. Moreover, many consumers are not yet aware of benefits associated with the use of the rinse aid and, thus, omit the use of the rinse aid entirely. By incorporating the rinse aid directly into an autodish detergent and having it released only in the final rinse, it could be ensured that glass appearance is enhanced without a need for a separate use or purchase of the rinse aid by a consumer.

Accordingly, it is an object of the present invention to provide a dishwashing detergent tablet which delivers convenience and improved cleaning performance in addition to improved storage stability.

It is another object of the present invention to provide a dishwashing detergent tablet which releases sequentially ingredients contained therein.

It is yet another object of the present invention to provide a dishwashing detergent tablet which contains both an enzyme and a chlorine bleach.

It is yet another object of the present invention to provide a dishwashing detergent tablet which releases an enzyme prior to a release of a chlorine bleach, and which releases the chlorine bleach after the enzyme had sufficient time to perform its cleaning function in an aqueous cleaning environment of a dishwashing machine.

It is still another object of the present invention to provide a dishwashing detergent tablet which contains both a dishwashing detergent composition and a rinse aid and which releases the rinse aid after detergent cleaning has been accomplished.

It is still another object of the present invention to provide methods of dishwashing by the use of the tablets disclosed herein.

Other objects and advantages will appear as the description proceeds.

SUMMARY OF THE INVENTION

The attainment of the above objects is made possible by this invention which includes a machine dishwashing detergent tablet containing at least:

a) an inner layer;

b) a barrier layer surrounding the inner layer; and c) an outer layer surrounding the barrier layer.

It should be understood that a tablet containing any number of inner layers each surrounded by its own barrier layer is within the scope of the instant invention.

The total amount of ingredients in the inner layer, the barrier layer and the outer layer is such that the tablet of the present invention contains about 10% to about 99% of a builder, and an amount of an alkaline source sufficient to provide a pH of a 0.1% solution by weight of the tablet of greater than about 9.0 during a dishwashing cycle of a dishwashing machine.

In the tablet according to the present invention, the inner layer is enclosed on all sides by the barrier layer and the barrier layer is enclosed on all sides by the outer layer.

When the tablet of the present invention comes into contact with an aqueous environment of a dishwashing machine, the only layer of the tablet available for dissolving is the outer layer. The barrier layer of the tablet comes into contact with the aqueous environment only after the outer layer has dissolved. The inner layer of the tablet comes into contact with the aqueous cleaning environment of the dishwashing machine only after both the outer layer and the barrier layer have dissolved or disintegrated.

The term "sequential release" as used herein means that the dissolution of the outer layer and the dissolution of the inner layer are separated in time. The sequential release is an essential property of the dishwashing tablet of the present invention. The time interval between dissolution of the outer layer and the dissolution of the inner layer depend on the particular embodiment of the invention and is generally from about 1 to about 53 minutes.

All layers of the inventive tablet must disintegrate in an aqueous cleaning environment of a dishwashing machine by the end of a dishwashing session. Although it is not necessary that each ingredient of the tablet described herein is water soluble, all layers of the tablet must dissolve, disperse, disintegrate or become dissipated in the aqueous cleaning environment of the dishwashing machine, so that no structural elements of the tablet remain in the dishwashing machine at the end of the dishwashing session.

Primarily, the sequential release property and other properties discussed above are attained in the tablet of the present invention by the particular choice of an ingredient for the barrier layer, the ingredient having a suitable disintegration rate at a temperature in the range of about 100° F. to about 160° F., in an aqueous cleaning environment of a dishwashing machine to provide the desired sequential release in the inventive tablet.

Examples of suitable ingredients for the barrier layer of the inventive tablet include but are not limited to water-soluble polymers, water-swellable polymers, soaps, fatty acids and waxes or mixtures thereof.

The relative thicknesses of the inner layer, the barrier layer and the outer layer also influence the disintegration rate of the tablet. Furthermore, the relative thicknesses of the inner layer, the barrier layer and the outer layer must also be such as to accommodate the ingredients of the tablet which are distributed between the inner layer, the barrier layer and the outer layer.

In one preferred tablet of the present invention (Tablet A, described in greater detail below) the outer layer of the tablet includes an enzyme, and the inner layer includes a source of chlorine bleach. The tablet provides an improved storage stability by accommodating the enzyme and the chlorine bleach in different layers separated by the barrier layer. Moreover, the dissolution of the enzyme and the dissolution of the chlorine bleach are separated in time. Thus, the tablet of the present invention releases the enzyme and affords sufficient time for the enzyme to perform its cleaning function prior to the release of the chlorine bleach.

In another preferred tablet of the present invention (Tablet B, described in greater detail below) the outer layer of the tablet contains a dishwashing composition, preferably including either a chlorine bleach or an enzyme, and the inner layer of the tablet contains a rinse aid. Thus, the tablet of the invention releases the dishwashing composition and affords sufficient time for accomplishing dishwashing prior to a release of the rinse aid.

The present invention also provides a method of dishwashing which includes placing a tablet of the present invention in a dishwashing machine, preferably in a dispenser of the dishwashing machine. A particularly preferred method of dishwashing according to the present invention includes placing the first tablet of the present invention (preferably Tablet A) in a prewash dispenser of the dishwashing machine and placing the second tablet of the present invention (preferably Tablet B) in a main wash dispenser of the dishwashing machine.

The invention also provides a method of treating dishware with detergent and rinse aid by placing in a dishwashing machine the tablet of the present invention, the inner layer of the tablet containing a rinse aid formulation.

The tablet of the present invention is particularly suitable for dishwashing in domestic dishwashing machines but may also be used in institutional dishwashing machines.

DETAILED DESCRIPTION OF THE INVENTION

Figure 1:
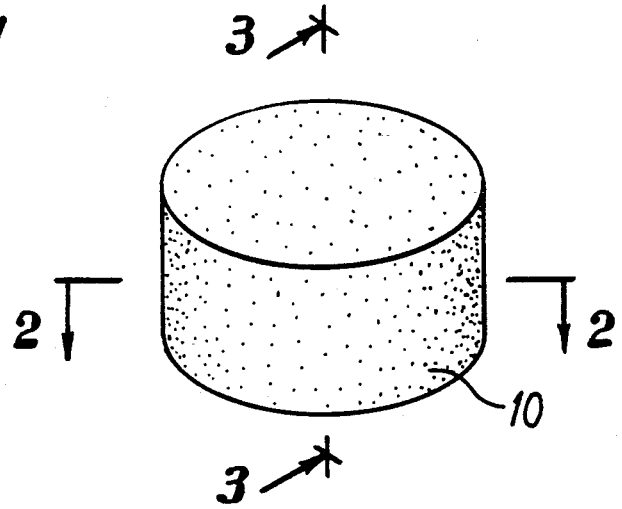
FIG. 1 is a perspective view of a dishwashing detergent tablet according to a preferred embodiment of the present invention.
Figure 2:
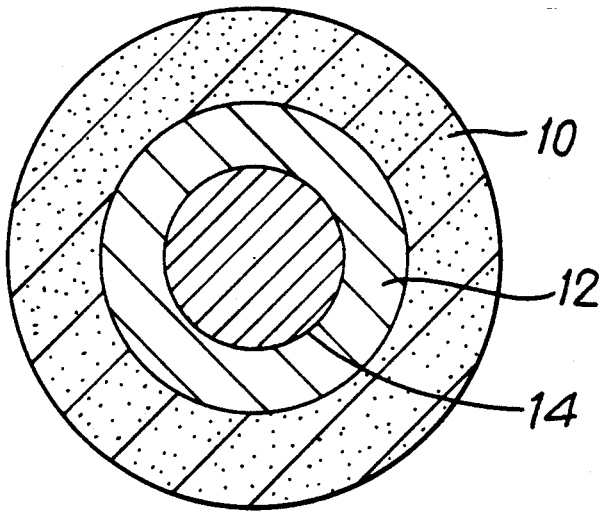
FIG. 2 is a cross-sectional view from above taken along lines 2—2 of FIG. I.
Figure 3:
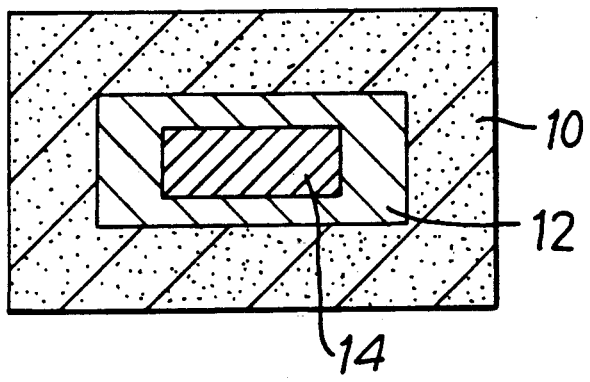
FIG. 3 is a cross-sectional view from the side taken along lines 3—3 of FIG. I.

Referring to FIG. 2 and FIG. 3, the tablet of the present invention includes an outer layer 10, a barrier layer 12 which is surrounded by the outer layer 10, and an inner layer 14 which is surrounded by the barrier layer 12.

Although any number of layers may be included in the tablet of the present invention, the tablet preferably contains from 3 to 7, most preferably 3, layers.

The ultimate shape of the tablet can be any suitable one, such as cylindrical, hexagonal, square, cylindrical with truncated faces, triangular, etc. Preferably, the tablets of the invention are of cylindrical disc-like shape. Preferred cylindrical tablets of this invention have a diameter from about 26 to about 36 mm, preferably from about 28 to about 34 mm and a thickness from about 14 to about 24 mm, preferably from about 16 to about 22 mm.

As will be appreciated, the tablets are particularly useful when placed in a prewash or a main wash dispenser of a dishwashing machine.

Consequently, the tablet's dimensions are preferably such that the tablet fits in the prewash and/or the main wash dispenser of the dishwashing machine. Based on the size of the currently used dishwashing dispensers, particularly preferred tablets of the invention have a maximum diameter of about 31 mm and a maximum thickness of about 19 mm.

The ingredients of the dishwashing tablets of the present invention may be distributed in various ways between the inner layer, the barrier layer and the outer layer. The ingredient of the outer layer may be the same as or different from the ingredient of the inner layer.

The first essential ingredient of the dishwashing tablets according to the present invention is a builder. The term "builder" as used in this description means all materials which tend to remove polyvalent metal ions (usually calcium and/or magnesium) from a solution either by ion exchange, or complexation, or sequestration, or suspension or precipitation. The tablet of the invention contains organic and/or inorganic builders such as alkali metal ortho-, pyro and tripolyphosphates and hexametaphosphates, silicates, carbonates, zeolites, borates, citrates, oxydisuccinates, carboxymethyloxysuccinates, nitrilotriacetates, citrates and ethylenediamine-tetraacetates, polymeric polyelectrolytes such as polyacrylates, polymaleates, polyacetates, other organic and inorganic builder compounds and mixtures thereof. The tablets of the invention may be formulated in substantial absence of any phosphate builders.

In the preferred embodiments of this invention, sodium or potassium tripolyphosphate or sodium or potassium hexametaphosphate are used. Mixtures of these phosphate salts with carbonates and silicates are especially preferred.

Silicate synergistically supports the cleansing power of phosphates and, additionally, inhibits corrosion. As silicates, alkali metal metasilicates and alkali metal silicates with a weight ratio of $SiO_2/Na_2O$ and/or $SiO_2/K_2O$ of from 4:1 to 1:1 may be used. Silicates having different degrees of hydration, such as nonhydrate, pentahydrate or anhydrous silicate may be employed in the present invention. Preferably, silicate is used in a solid form, such as Britesil H20$^R$ and Britesil H24$^R$ sold by PQ Corporation.

The amount of the builder in the tablet varies from 10 to 99% by weight of the tablet, preferably from 30% to 70% and most preferably from 50 to 85%. The builder may be distributed among the inner layer, the barrier layer and the outer layer. Preferably, at least about 50% to about 99% of the builder of the tablet, most preferably about 60% to about 90%, is included in the outer layer of the tablet.

Further, the tablets of the present invention should be formulated such that they provide in a wash liquor, during a dishwashing cycle, a pH of at least about 9.0, preferably a pH in the range of from 9.5 to 12.5, at a use concentration of about 0.1% solution by weight of the tablet in water. The term "dishwashing cycle" as used in this description refers to either a prewash cycle, or a prerinse cycle, or a main wash cycle. The detergent may be as strongly alkaline as is permitted legally. The preferred builders employed in the present invention are alkaline, so that it is typically not necessary to use additional alkaline sources in order to adjust pH. However, if necessary, caustic agents, such as sodium hydroxide, may be additionally present.

The barrier layer of the tablet contains an ingredient or a mixture of ingredients having a suitable disintegration rate in an aqueous cleaning environment of a dishwashing machine at a water temperature in the range of from about 100° F. to about 160° F., to provide the sequential release of the outer and inner layers, i.e. to provide the dissolution of the outer layer and the inner layer which are separated in time.

Illustrative but not limiting examples of suitable ingredients for the barrier layer are water-soluble polymers, water-swellable polymers, mixtures of water-soluble polymers, mixtures of water-swellable polymers, soaps, fatty acids, waxes and mixtures thereof having a suitable water-solubility or water-swellability rate to provide the sequential release in the tablet of the invention. Preferably, at least 50% of the barrier layer material employed, more preferably at least 80%, is solid at room temperature (20°-25° C.). Solid mixtures of liquid and solid materials may be employed.

The disintegration rate of the barrier layer determines, in part, the length of a time interval between the dissolution of the outer layer and the dissolution of the inner layer. Ingredients which have a relatively slower dissolution rate are employed when a relatively longer time interval is desired between release times of two layers (e.g., the outer and the inner layers). Ingredients which have a relatively faster dissolution rate are employed when a relatively shorter time interval is desired between release times of two layers.

The disintegration rate of the ingredient at a particular temperature may be studied by compressing the ingredient to form a tablet and, subsequently, conducting a tablet disintegration test in a beaker and/or in a dishwashing machine. The disintegration test for determining disintegration rates of various ingredients may be used as a pre-screening test in choosing suitable ingredients. The test is described in more detail in Example 1.

When the ingredient of the barrier layer is a polymer, the polymer is preferably selected from the group consisting of a maleic acid/acrylic acid copolymer, a salt of maleic acid/acrylic acid copolymer, ethylene maleic anhydride cross-linked copolymer, polyethylene glycol, polyvinyl pyrrolidone, acrylic acid polymer, a salt of acrylic acid polymer, carboxymethylcellulose, polyvinylalcohol, cellulose ether and mixtures thereof.

Preferred polymers for use in the present invention are as follows:

| Polymer | Trademark | Supplier |
|---|---|---|
| Maleic acid/Acrylic acid | Sokalan CP5 | BASF |

-continued

| Polymer | Trademark | Supplier |
|---|---|---|
| copolymer, sodium salt (MW = 70,000) | | |
| Ethylene Maleic Anhydride cross-linked copolymer (MW = 1,000,000) | EMA-61 | Monsanto |
| Polyethylene Glycol Carbide (MW = 7,000–9,000) | PEG 8000 | Union |
| Sodium Carboxymethyl Cellulose (MW = 250,000) | CMC 7M | Hercules |
| Polyvinyl Pyrrolidone (MW = 700,000) | PVP K-90 | GAF |
| Acrylic acid polymer resin (MW = 4,000,000) | Carbopol 940 | B. F. Goodrich |

Among soaps, fatty acids and waxes particularly suitable for the barrier layer are calcium salts of long chain, i.e. $C_{18}$ and higher, fatty acids; long chain ($C_{18}$ and higher) fatty acids and high melting point (melting point in the range from 105°–150° F., preferably 125°–142° F., and at any rate not higher than 150° F.) waxes.

The barrier layer which provides the sequential release may be coated with fatty acids, waxes or soaps in order to increase the storage stability of the tablet, especially when the tablet contains a source of chlorine bleach. A relatively thin coating of fatty acids, waxes or soaps is not considered a separate layer herein. Another particularly preferred optional ingredient included in the barrier layer is a plasticizer. The plasticizer may be selected from the group consisting of glycols (glycerol, propylene glycol, hexylene glycol, ethylene glycol), sorbitol, glycerin, and mixtures thereof. The amount of the plasticizer is from 0.01 to 10%, preferably from 0.1 to 5%.

The particular choice of the ingredient for the barrier layer is determined by the disintegration rate of the ingredient at a temperature in the range of from 100° F. to about 160° F. in an aqueous cleaning environment of a dishwashing machine and the time interval necessary to achieve the desired separation in release times of the layers separated by the barrier layer. The length of the time interval between the release of the outer layer and the release of the inner layer depends on the particular embodiment of the present invention. In the preferred embodiments of the present invention the desired time intervals between release times of the inner and outer layers are primarily determined by a time program of a dishwashing machine.

A dishwashing session of a typical domestic dishwashing machine (such as Kenmore®, General Electric or Kitchen Aid®) generally consists of at least prewash, prerinse, main wash and rinse cycles.

As defined herein, the dishwashing session does not include the drying cycle. The average lengths of the prewash, prerinse, main wash and rinse cycles are on the average from 6 to 14 minutes, from 5 to 9 minutes, from 11 to 15 minutes and from 6 to 17 minutes, respectively.

The lengths of the prewash, the prerinse, main wash and rinse cycles for two typical domestic dishwashing machines are as follows:

| | Kitchen Aid ® | Kenmore ® |
|---|---|---|
| Prewash | 13.5 | 7.5 |
| Prerinse | 9.0 | 6.25 |
| Wash | 13.5 | 13.0 |
| Rinse | 6.0 | 14.75 |
| | 42.0 | 41.5 |

The dishwashing session may be 5 to 10 minutes longer if an extra prewash cycle is employed as is sometimes desirable for heavily soiled dishware cleaning. The dishwashing session may also be shorter by 5 to 10 minutes when the dishware load is lightly soiled.

According to the first aspect of the present invention, when the desired interval between release times of the layers, e.g. the outer layer and the inner layer, is relatively short, the ingredient of the barrier layer is selected which has a suitable disintegration rate in order to provide at a wash liquor temperature of from about 100° F. to about 160° F. in a dishwashing machine, from about 1 to about 20 minutes, preferably from about 2 to about 9 minutes and most preferably from about 4 to about 6 minutes prior to a release of the inner layer ingredient (the time intervals include dissolution of the outer layer as well). Preferably, the wash liquor temperature is from about 130° F. to about 150° F.

A mixture of polyacrylic acid/maleic acid copolymer and polyethylene glycol is a preferred ingredient employed for the barrier layer according to the first aspect of the invention. The mixture of the polyacrylic acid/maleic acid copolymer and polyethylene glycol wherein the weight ratio of polyacrylic acid/maleic acid copolymer to polyethylene glycol is from about 1:3 to about 3:1, the weight ratio of 1:1 being most preferred, is the particularly preferred ingredient choice for the barrier layer according to the first aspect of the present invention.

According to the second aspect of the present invention, when the desired interval between release times of the layers, e.g. the outer layer and the inner layer, is relatively long, the ingredient of the barrier layer is selected which has a suitable disintegration rate in order to provide at a wash liquor temperature of from about 100° F. to 160° F. in a dishwashing machine, from about 6.5 to about 49 minutes, preferably from about 6.5 to about 34 minutes and most preferably from about 6.5 to about 24 minutes prior to the release of the inner layer ingredient (the time intervals include dissolution of the outer layer as well). Preferably, the wash liquor temperature is from about 130° F. to about 150° F.

A mixture of the polyacrylic acid/maleic acid copolymer and ethylene maleic anhydride crosslinked polymer is a preferred ingredient employed for the barrier layer according to the second aspect of the present invention. The mixture of the polyacrylic acid/maleic acid copolymer and ethylene maleic anhydride crosslinked polymer wherein the weight ratio of polyacrylic acid/maleic acid copolymer to ethylene maleic anhydride crosslinked polymer is from about 2:1 to about 10:1, the weight ratio of 6:1 being most preferred, is the particularly preferred polymer choice according to the second aspect of the present invention.

The release time intervals also depend on the relative thicknesses of the inner layer, the outer layer and the barrier layer. The thicknesses also depend on the overall dimensions of the tablet and, thus, are based on the dimensions of the current dishwasher dispensers. The thicknesses may be adjusted by controlling the amounts of the ingredients and the pressure used in making the tablet.

Thus, in the preferred tablet according to the first aspect of the present invention the thickness of the inner layer is about 3 to about 6 mm, the total thickness of the inner layer and the barrier layer is from about 6 to about 9 mm, and the total thickness of the inner layer, the barrier layer and the outer layer is about 9 to about 13 mm. In the preferred tablet according to the first aspect the diameter of the inner layer is in the range from 8 to 11 mm, the total diameter of the inner layer and the barrier layer is in the range of from 11 to 15 mm, and the total diameter of the inner layer, the barrier layer and the outer layer is in the range of from 28 to 34 mm.

In the preferred tablet according to the second aspect of the present invention the thickness of the inner layer is about 9 to about 12 mm, the total thickness of the inner layer and the barrier layer is from about 12 to about 16 mm, and the total thickness of the inner layer, the barrier layer and the outer layer is about 17 to about 21 mm. In the preferred tablet according to the second aspect the diameter of the inner layer is in the range from 14 to 17 mm, the total diameter of the inner layer and the barrier layer is in the range of from 17 to 21 mm, and the total diameter of the inner layer, the barrier layer and the outer layer is in the range of from 28 to 34 mm.

Total length of a dishwashing session (excluding the drying cycle) of domestic dishwashing machines generally ranges from about 30 minutes to 55 minutes. Thus, the preferred tablets of the present invention disintegrate within 30 to 55 minutes, preferably within 40 to 50 minutes. Although the tablet must disintegrate by the end of the dishwashing session or prior to the drying cycle, the tablet may disintegrate earlier.

The tablet according to the present invention preferably includes at least one ingredient selected from the group consisting of a detergent-active compound, a source of a chlorine bleach, an enzyme, a source of an oxygen bleach and mixtures of these ingredients. Furthermore, according to the present invention, the tablet which is formulated to contain a rinse aid in the inner layer necessarily includes a nonionic surfactant in the inner layer, the nonionic surfactant functioning as the rinse aid.

A detergent-active compound employed in the tablets of the present invention may be any detergent active compound, such as soaps, synthetic anionic, nonionic, amphoteric detergent surfactants and mixtures thereof. Preferably, a nonionic detergent surfactant is used, especially a low-foaming one. The nonionic surfactant description that follows is applicable to all tablets of the invention, including the tablets that contain the rinse aid.

The nonionic surfactant component results in a preparation which has little or no tendency to foam by itself or in the presence of a foam-producing food soil. Suitable examples of such nonionic detergent surfactants can easily be found in M. Schick "Nonionic Surfactants" (1967).

Nonionic surfactants include those detergent compounds which contain an organic hydrophobic group and a hydrophilic group which is a reaction product of a solubilizing group such as carboxylate, hydroxyl, amido or amino with ethylene oxide or propylene oxide or with a polyhydration product thereof such as polyethylene glycol.

Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types suitable as nonionic surfactants include:

(a) polyoxyethylene and/or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain a myristic acid, stearic acid and lauric acid.

(b) polyoxyethylene and/or polyoxypropylene condensates of aliphatic alcohols, whether linear- or branched-chain and unsaturated or saturated, containing from about 6 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Included within this category are nonionic surfactants having the formula:

$$RO-(\underset{\underset{R'}{|}}{CH_2CHO})_x(CH_2CH_2O)_y(\underset{\underset{R''}{|}}{CH_2CHO})_z-H$$

wherein R is a linear, alkyl hydrocarbon having an average of 6 to 10 carbon atoms, R' and R'' are each linear alkylhydrocarbons of about 1 to 4 carton atoms, x is an integer from 1 to 6, y is an integer from 4 to 15 and z is an integer from 4 to 25. A particularly preferred example of this category is sold under the registered trademark of Poly-Tergent SLF-18 by the Olin Corporation, New Haven, Conn. Poly-Tergent SLF-18 has a composition of the above formula where R is a $C_6$–$C_{10}$ linear alkyl mixture, R' and R'' are methyl, x averages 3, y averages 12 and z averages 16. Another surfactant from this category has the formula:

$$C_{8-10}O(CH_2CH_2O)_{7.81}(\underset{\underset{CH_3}{|}}{CH_2CHO})_{14.45}H$$

(c) polyoxyethylene or polyoxypropylene condensates or alkyl phenols, whether linear-or branched-chain and unsaturated or saturated, containing from about 6 to about 12 carbon atoms and incorporating from about 5 to about 25 moles of ethylene oxide or propylene oxide.

(d) polyoxyethylene derivatives of sorbitan mono-,di-,and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monoleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono- di-, or tri-acid esters.

(e) polyoxyethylene-polyoxypropylene block polymers having the formula:

$$HO(CH_2CH_2O)_a(CH(CH_3)CH_2)_b(CH_2CH_2)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available, for example, under the trademark "Pluronics", a product of BASF Corporation.

Examples of other suitable surfactants include low-foaming anionics such as dodecyl hydrogen phosphate, methyl napthalene sulfonate, sodium 2-acetamido-hexadecane-1-sulfonate and mixtures thereof. Preferred anionics include materials selected from the class of branched alkali metal mono- and di-$C_{8-14}$ alkyl diphenyl oxide mono- and disulfonates and linear alkali metal mono- and di $C_{8-14}$ alkyl diphenyl oxide mono- and disulfonates. Mixtures of any of the foregoing surfactants or of surfactants from any of the enumerated categories may be used.

Preferably, the nonionic surfactant employed in the present invention is a solid. Solid surfactants are particularly preferred for the tablets of the invention wherein the surfactant is included in the inner layer of the tablet as the rinse aid. A solid surfactant is defined herein as having a melting point above 20° C. Preferred solid surfactants have a melting point higher than 25° C. Where the surfactant to be employed is a solid surfactant, the surfactant is preferably prepared in particulate form. This can be done in a number of ways. Thus, the surfactant may be cut into small particles by using a type of macerator or mixer with cutting blades. Alternatively, a surfactant melt can be spray-dried to give surfactant particles. The surfactant in particulate form may then be mixed with other ingredients; the mixture subsequently being compressed to form a layer of the tablet. Solid surfactants, within the meaning of the present invention, can also include a mixture of surfactant and surfactant-like materials which mixture is solid within the above definition. Thus, mixtures of solid and liquid surfactants can, when co-melted, form a solid mixture. Examples of solid surfactants particularly useful in the present invention include polyoxyethylene ethers sold under the trade names Brij ®(35, 35SP, 56, 58, 76, 78, 98, 99) by ICI Americas Incorporated, ethoxylated straight chain alcohols sold under the trademark Plurofac ® ( A-38 and A-39) by BASF Corporation, dialkyl phenoxypolyethyleneoxyethanol sold under the trademark Igepal ® DM-970 and polyethoxylated alcohol sold under the trademark Emulphogene ®TB-970 by GAF Chemicals Corporation, and polyethylene glycol sold under the trademark PEG E-series by Dow Chemical Company.

When surfactants are liquid in character, such may be sprayed onto particles making up the solid composition to be compressed. Useful builder salts, for example sodium carbonate, can be effective carriers. In the rinse aid-containing tablets of the invention wherein the inner layer includes the nonionic surfactant as the rinse aid, solid acids, such as citric acid, can also be used as the carrier for the liquid nonionic surfactant.

The amount of the detergent active compound should be such that detergency and wetting are improved and excessive foaming, due to certain proteinaceous soils, is reduced or suppressed. In general, the amount is between 0.05% and 15% by weight, in particular, between 0.5 and 10%, and most preferably from 1% to 5% by weight of the tablet. The detergent active compound may be distributed between the outer layer and the inner layer.

The outer layer of the tablet preferably includes from 10% to 99% of the builder and from 0.5% to 10% of the nonionic surfactant.

When the nonionic surfactant is employed as the rinse aid, the inner layer of the tablet contains the nonionic surfactant in an amount from about 1% to about 100%, preferably from about 5% to about 40% and most preferably in an amount from about 10% to about 30% by weight of the inner layer. The inner layer of the tablet formulated to contain the rinse aid may optionally include an organic acid, particularly hydroxycarboxylic acid such as citric acid, lactic acid, malic acid and the like. The amount of the organic acid is typically in the range of from 1% to 99%, preferably from 60% to 95%, and most preferably from 70% to 90% by weight of the inner layer. The ratio of the nonionic surfactant rinse aid to the organic acid is preferably from about 2:1 to about 1:8, more preferably from about 1:2 to about 1:6.

The tablets of the invention preferably include a source of halogen bleach, particularly chlorine bleach. The source of chlorine bleach is typically employed in an amount corresponding to 0.1% to 20%, preferably 0.5% to 10% by weight of available chlorine. Chlorine bleach greatly improves cleaning performance of the dishwashing detergents, in particular their ability to remove stains left by tea, coffee or fruit juices from the surface of the dishes. Additionally, active chlorine is an excellent sanitizer and germicide.

Among sources of the chlorine bleach are organic and/or inorganic compounds capable of having their chlorine liberated in the form of active chlorine on dissolution in water. Typical examples are alkali metal hypochlorites, chlorinated trisodium phosphate, chlorinated sulphonamides, halogenated hydantoins, polychlorocyanurates (usually alkali metal, e.g. sodium or potassium, salts), and mixtures thereof. Suitable chlorine-releasing agents are also disclosed in the ACS momograph entitled "Chlorine—Its Manufacture, Properties and Uses" by Sconce, published by Reinhold in 1962. This book is incorporated by reference.

The source of chlorine bleach may be included in the outer layer or in the inner layer of the tablets of the present invention. When the tablet includes an enzyme and the source of chlorine bleach, the enzyme and the source of chlorine bleach are contained in different layers. Preferably, the chlorine bleach is contained in a layer which is released after a release of a layer containing the enzyme. Thus, if the enzyme is included in the outer layer, the source of chlorine bleach is contained in the inner layer. In this manner sufficient time is allowed for the enzyme to perform its cleaning function prior the release of the chlorine bleach source.

Although the chlorine bleach is preferred, a source of oxygen bleach may also be included in the tablets of the invention. Among the oxygen-releasing bleaches, particularly preferred in the present invention is a peroxygen salt such as sodium perborate tetrahydrate or monohydrate, percarbonate, persilicate, persulfate, dipersulfate and the like. Other peroxygen compounds include perphosphates, peroxide and perpolyphosphates. It may also be advantageous to combine such a persalt with a bleach activator therefor.

The activators for peroxygen salts are organic compounds which react with the peroxygen salt in solution to form an organic peroxygen acid as the effective bleaching agent. Numerous examples of such activators are known. Preferred activators for use in the present invention are tetraacetylethylenediamine, tetraacetylglycoluril, glucosepentaacetate, xylose tetraacetate, sodium benzoyloxybenzene sulfonate and choline sulfophenyl carbonate.

Organic peroxides such as urea peroxide, diperoxydodecanoic acid or lauroyl peroxides may be used.

The oxygen bleach is employed in the tablets of the present invention in an amount corresponding to from about 0.05% to about 10%, preferably from about 0.1% to about 5%, most preferably from about 0.5% to about 3% of available oxygen.

Where also the activator for the bleach is included, the ratio between the peroxygen salt and the activator lies in the range of from 8:1 to 1:3, preferably 4:1 to 1:2, and most preferably is 2:1.

Another particularly preferred ingredient of the tablets disclosed herein is an enzyme. The enzymes may be of the amylolytic, proteolytic and lipolytic type or mixtures thereof. The amylolytic enzymes for use in the present invention can be those derived from bacteria or fungi. Preferred amylolytic enzymes are those described in British Patent Specification No. 1 296 839, cultivated from the strains of *Bacillus licheniformis* NCIB 8061, NCIB 8059, ATCC 6334, ATCC 6598, ATCC 11 945, ATCC 8480 and ATCC 9945 A. A particularly preferred enzyme is an amylolytic enzyme produced and distributed under the trade name, Termamyl, by Novo Industri A/S, Copenhagen, Denmark. These amylolytic enzymes are generally sold as granules and may have activities from about 2 to 10 Maltose units/milligram. The amylolytic enzyme is normally included in an amount of from 0.05% to 5% by weight, in particular of from 0.1 to 1.5% by weight.

The composition may, and preferably does, also contain a proteolytic enzyme. Examples of suitable proteolytic enzymes are the subtilisins which are obtained from particular strains of *B. subtilis* and *B. licheniformis*, such as those commercially available under the trade names Maxatase, supplied by Gist-Brocades NV, Delft, Netherlands, and Alcalase, supplied by Novo Industri A/S, Copenhagen, Denmark. Particularly preferred are the proteases obtained from a strain of *Bacillus* having a maximal activity throughout the pH range of 8–12, being commercially available under the trade names of Esperase and Savinase, sold by Novo Industri A/S. These proteolytic enzymes are generally sold as granules and may have enzyme activities of from about 500 to 1700 glycine units/milligram. The proteolytic enzyme is normally included in an amount of from about 0.1% to about 10% by weight, in particular of from 0.3 to 3% by weight.

Lipolytic enzymes may also be included in order to improve removal of fatty soils from dishes. The lipolytic enzymes are preferably included in an amount from about 0.5% to about 10%, preferably from 1% to 5%.

The total content of the enzyme in the tablets of the present invention is from about 0.05 to about 10%, preferably from about 0.1 to about 5%, most preferably from about 0.5 to about 3%.

A particularly preferred tablet according to the first aspect of the invention (Tablet A) contains the enzyme in the outer layer and the source of chlorine bleach in the inner layer. At a wash liquor temperature in the range of from about 100° F. to about 160° F. in the dishwashing machine, the outer layer of the tablet dissolves within the first 0.5 to 5 minutes, preferably within 1 to 5 minutes and most preferably within 2 to 3 minutes. The barrier layer disintegrates within the next 0.5 to 15 minutes, preferably within the next 1 to 4 minutes, most preferably within the next 2 to 3 minutes. Therefore, during the first 1 to 20 minutes, most preferably the first 4 to 6 minutes, the enzyme is allowed to perform its cleaning action on dishware in the absence of the chlorine bleach. The chlorine bleach of the inner layer is released within the final 2 to 4 minutes of the prewash cycle, allowing sufficient time for the chlorine bleach to clean the dishware, in particular, to remove stains prior to the end of the prewash cycle. In a preferred embodiment of the invention, the barrier layer of Tablet A is the mixture of polyacrylic acid/maleic acid copolymer and polyethylene glycol wherein the weight ratio of polyacrylic acid/maleic acid copolymer to polyethylene glycol is from about 1:3 to about 3:1, the weight ratio of 1:1 being especially preferred. Tablet A may be formulated such that the tablet disintegrates within 6 to 13 minutes (or by the end of the prewash cycle) at a water temperature in the range of from 100° F. to 160° F. in an aqueous cleaning environment of a dishwashing machine.

Tablet A of the present invention contains the source of chlorine bleach in an amount corresponding to from 0.1% to 20% of available chlorine, preferably 0.5% to 10% of available chlorine and from 0.05% to 10% of the enzyme, preferably from 0.1 to 5%.

The particularly preferred tablet according to the second aspect of the present invention (Tablet B) contains a dishwashing composition in the outer layer and a rinse aid in the inner layer. At a wash liquor temperature in the range of from about 100° F. to about 160° F., the outer layer of the tablet dissolves within the first 0.5 to 5 minutes, preferably within the first 1 to 5 minutes and most preferably within the first 2 to 3 minutes.

The desired length of time for the disintegration of the barrier layer of Tablet B depends on the particular dishwashing machine used, the length of the dishwashing session and the point of introduction of Tablet B in the dishwashing machine. Thus, if Tablet B is introduced in the dishwashing machine at the beginning of the dishwashing session:

| | Dishwashing Session Length (minutes) | | | |
|---|---|---|---|---|
| | Kenmore ® | | Kitchen Aid ® | |
| | Heavy Load 49 | Normal Wash 41.5 | Heavy Load 52.5 | Normal Wash 43.5 |
| Barrier layer disintegration time lenth range (minutes) | 30.5–46 | 23–38.5 | 36–48.5 | 27–39.5 |
| Barrier layer disintegration time length preferred time (minutes) | 39 | 31.5 | 45.5 | 36.5 |

If, however, Tablet B is introduced at the beginning of the main wash cycle, as is preferred, the barrier layer disintegrates within 8 to 23.5 minutes (Kenmore ®), preferably 16.5 minutes (Kenmore ®); and Within 1.5 to 14 minutes (Kitchen Aid ®), preferably 11 minutes (Kitchen Aid ®).

Therefore, during the first 6.5 to 49 minutes, most preferably during the first 6.5 to 24 minutes, the dishwashing detergent is allowed to perform its function, i.e. to clean the dishware. The rinse aid of the inner layer is released within the final 2 to 12 minutes, allowing sufficient time for the rinse aid to perform its function, in particular to minimize spotting and filming, prior to the end of the rinse cycle. Tablet B may be formulated such that the tablet disintegrates within 17 to 55 minutes (or by the end of the dishwashing session) at a water temperature in the range of from 100° F. to 160° F. in an aqueous cleaning environment of a dishwashing machine.

In a preferred embodiment of the present invention, the barrier layer of Tablet B is the mixture of polyacrylic acid/maleic acid copolymer and ethylene maleic anhydride crosslinked polymer wherein the weight ratio of polyacrylic acid/maleic acid copolymer to ethylene maleic anhydride crosslinked polymer is from about 2:1 to about 10:1, the weight ratio of 6:1 being most preferred.

The outer layer of Tablet B preferably includes either the enzyme and the builder or the source of chlorine bleach and the builder. The amounts of the enzyme, the alkaline builder, and the chlorine bleach in Tablet B are as described above. The nonionic rinse aid surfactant and other optional ingredients for the rinse aid of Tablet B have been discussed above.

The tablet according to the present invention may be formulated to combine the features of Tablet A and Tablet B. Such tablet releases sequentially the enzyme, the chlorine bleach and the rinse aid at the desired time intervals.

The tablets of the invention may, furthermore, contain other useful additives such as enzyme-stabilizing agents, reducing bleaching agents such as sodium sulphite, hydrotropes, fillers, perfumes, coloring agents, germicides, clays such as hectorites, up to 3% of anticorrosion agents such as fatty acids, benztriazole and so on. Clays assist in reduction of spot formation on glassware and may be present at from 0.1 to 5%.

Some surfactants tend to over-sud and the tablets of this invention, therefore, may include suds suppressing agents, typically used in an amount of from 0.001% to about 6%, preferably 0.05% to 3%. Preferred suds suppressing agents are silicone materials, particularly the polydimethylsiloxanes having the molecular weight within the range of from 200 to 200,000 and higher. Suitable polydimethylsiloxanes are commercially available from Dow Corning Corporation. Other useful suds suppressing agents include alkyl phosphate esters such as monostearyl phosphate and microcrystalline waxes.

The tablet may be provided with an outer coating. The coating enhances the external appearance and feel of the tablet and, additionally, minimizes the possibility of tablet abrasion, and reduces the risk that a person handling the tablet comes into direct contact with the relatively alkaline surface of the tablet. A wide range of water-soluble coatings is possible, the preferred materials including silicate solution, fatty acids, such as tallow fatty acids;. fatty alcohols; and polyethylene glycols. Other useful coating materials include cellulose acetate phthalate, polyacrylates, and mixtures thereof. A wide range of organic film-forming polymers can also be used. Examples of organic film-forming polymers include polyvinyl alcohols and gelatin. The coating can be applied using any of the well-known procedures for tablet coating. These include spraying-on, dipping, passing through a falling curtain of coating material, etc. If desired, coloring material, plasticizers and perfumes can be incorporated into the coating.

Other optional ingredients include binders, tablet disintegrating agents and fillers. Binders such as talc and starch tend to diminish sticking and may be included in the tablets of the invention in an amount of about 0.1% to about 1%, usually about 0.5%.

Tablet disintegrating agents promote break-up of tablets and may be employed in the tablets of the present invention. Examples of disintegrating agents include formaldehyde-casein, colloidal silica, starch alginic acid and salts thereof, Veegum clays, sugars, gelatin, crosslinked carboxymethylcellulose (e.g., AC-Di-Sol ® sold by FMC), polyvinylpyrrolidone and zeolites. Combinations of these materials can also be used. Generally from 0.5% up to 10% of tablet disintegrating agents are employed.

The tablets of the present invention may also include fillers, usually sodium chloride or sodium sulfate or mixtures of these components. However, binders and disintegrating agents and fillers do not contribute to the cleaning properties and/or are not totally water-soluble; there is no need to use these auxiliaries in the production of the tablets in accordance with the present invention. Thus, the use of binders, fillers and disintegrating agents is preferably avoided.

Typical domestic dishwashing machines contain two dispensers generally accommodated in the door of the machine. The prewash dispenser remains open, allowing the detergent to be immediately released in the prewash while the main wash dispenser is closed, automatically opening only when the main wash cycle is reached.

The tablet of the present invention may be introduced into any part of the dishwashing machine, but is preferably placed in the dispenser. The invention provides a method of treating dishware with detergent and rinse aid by introducing in the dishwashing machine, preferably placed in a dispenser, the rinse-aid containing tablet of the present invention, the tablet preferably being Tablet B described herein.

A preferred method of dishwashing according to the present invention includes introducing two tablets of the invention into the dishwashing machine: the first tablet is placed into the prewash dispenser and the second tablet is placed into the main wash dispenser. Preferably, the tablet placed in the prewash dispenser is the tablet according to the first aspect of the invention and the tablet placed in the main wash dispenser is the tablet according to the second aspect of the invention.

A particularly preferred method of dishwashing involves placing Tablet A in the prewash dispenser and Tablet B in the main wash dispenser. Tablet A delivers the enzyme and, subsequently, the chlorine bleach to the wash liquor in the dishwashing machine. Tablet B comes into contact with the wash liquor only at the start of the main wash cycle, and delivers the builder and other optional dishwashing ingredients and, subsequently, delivers the rinse aid. Even with difficult soil, such as for example burnt-on milk or baked-on porridge oats, dishes washed according to the methods of the present invention are cleaner than conventionally washed dishes.

The tablets of this invention can be made by using SPEX 3624B-115 X-PRESS Motorized Hydraulic Press (35 ton) purchased from SPEX Industries, Inc. and SPECAC stainless steel evacuable pellet dies purchased from SPEX Industries and Aries Co. Pharmaceutical tableting machines such as Bicotta and Drycotta compression machines made by Thomas Engineering can also be used. The preferred method of making tablets involves successive compressing steps by using the SPEX machine, as follows:

(a) preparing a first mixture including at least one ingredient of the tablet;
(b) placing the first mixture in a first die and compressing the mixture to obtain the inner layer;
(c) preparing a second mixture including a suitable ingredient for the barrier layer;
(d) placing a portion of the second mixture in a second die, the second die having a larger diameter than the first die;
(e) placing the compressed inner layer in the second die;
(f) placing the remaining portion of the second mixture in the second die and compressing the second mixture and the inner layer to obtain an intermediate tablet composed of the inner layer and the barrier layer;
(g) preparing a third mixture including at least one ingredient of the tablet;
(h) placing a portion of the third mixture in a third die, the third die having a larger diameter than the second die;
(i) placing the intermediate tablet in the third die;
(j) placing the remaining portion of the third mixture in the third die and compressing the third mixture and the intermediate tablet to obtain the tablet.

All tablets of the invention, including Tablet A and Tablet B can be prepared by the process described above. Although the same pressure values may be used for manufacturing all tablets of the invention, the preferred pressure values are as follows:

| | Pressure (kg/cm$^2$) | |
|---|---|---|
| | Tablet A | Tablet B |
| inner layer | 2,300–18,000 | 900–7,000 |
| barrier layer | 3,425–10,300 | 1,600–4,800 |
| outer layer | 600–1,800 | 600–1,800 |

For making Tablet A pellet dies having diameters of 10 mm, 13 mm and 31 mm are preferably used. For making Tablet B pellet dies having diameters of 16 mm, 19 mm and 31 mm are preferably used.

In order to form the tablet, preferably at least 50% of the ingredients, most preferably at least 80% are solid.

To improve the mechanical strength and increase the disintegration rate solid materials included in the tablet of the present invention are preferably in a granular form, the size of granules being in the range from about 300 microns to about 2,000 microns, preferably from about 1,000 to about 1,500 microns. Although it is not necessary that all ingredients of the tablet are in the granular form, preferably at least major ingredients of the tablet such as phosphate, silicate, the polymer of the barrier layer, the solid nonionic surfactant, the enzyme and the chlorine bleach source are in the granular form.

Liquid materials may be either blended with the granules or sprayed on the granules.

Some difficulties may be encountered with regard to release of tablets from the dies. These can be overcome by covering the die with release or lubricating agents such as calcium stearate, talcum powder, siliconized talcum, stearic acid, paraffins and mixtures thereof.

Tablets weighing from 5 grams to 50 grams are preferred. Larger tablets are generally more prone to break and, in addition, can only be formed at relatively low speeds, thus reducing output. With smaller tablets, the advantage over granulated or powder-form detergents in terms of handling would be reduced. As described above, the size of the tablets is also controlled by the size of the dishwashing machine dispenser in accordance with the preferred method of use of the dishwashing tablets according to the present invention.

The following examples illustrate the dishwashing tablets of the present invention and methods of use of the tablets.

EXAMPLE 1

Disintegration Rate of Polymers

The disintegration rate of various polymers and polymer mixtures was tested. Polymers that were tested are listed in Table 1.

TABLE I

| | POLYMER COMPOSITIONS | | | | | |
|---|---|---|---|---|---|---|
| Composition | A | B | C | D | E | F |
| Sokalan CP-5 Polyacrylic acid-maleic Acid copolymer | 100 | 50 | — | — | 75 | 85.7 |
| PEG 8000 Polyethylene glycol | — | 50 | 100 | — | — | — |
| EMA-61 Ethylene maleic anhydride cross-linked polymer | — | — | — | 100 | 25 | 14.3 |

I. Disintegration of a Polymer Tablet in a Beaker

A. Each polymer composition listed in Table 1 was mixed with 7.0% by weight of the tablet of yellow dye (Acid Yellow #17) and the resulting mixture was tableted under a pressure of 6852 kg/cm$^2$ to form polymer tablets having a diameter of 13 mm, a thickness of 7 mm and a weight of 1.9 grams.

The disintegration of the polymers was tested in a beaker according to the following procedure:

B. One liter of distilled water was placed in a 2000 ml jacketed beaker which was thermostated at the tested temperature (110° F. and 140° F., respectively) by means of a Haake FK water heater/circulator. The water was stirred at a moderate (200–250 rpm), reproducible rate with a magnetic stir bar. A fiber-optic probe tip, 2 mm gap (4 mm optical path length), was immersed in the water. Brinkman PC800 Colorimeter equipped with a 420 nm filter was used to monitor the absorbance of the solution. After the colorimeter was set to Absorbance=0.0000, a polymer tablet prepared in step (A) was dropped into the water simultaneously with the starting of a timer.

The absorbance of the yellow dye at 420 nm was recorded at time=0.25, 0.50, 0.75, 1.00, 1.33, 1.67, 2.00, 2.50, 3.0, 4.0, 5.0, 8.0, 11.0, 14.0, 17.0, and 20.0 minutes. The experiment ended at 20 minutes or upon total disintegration of the tablet, whichever occurred first.

Figure 4:
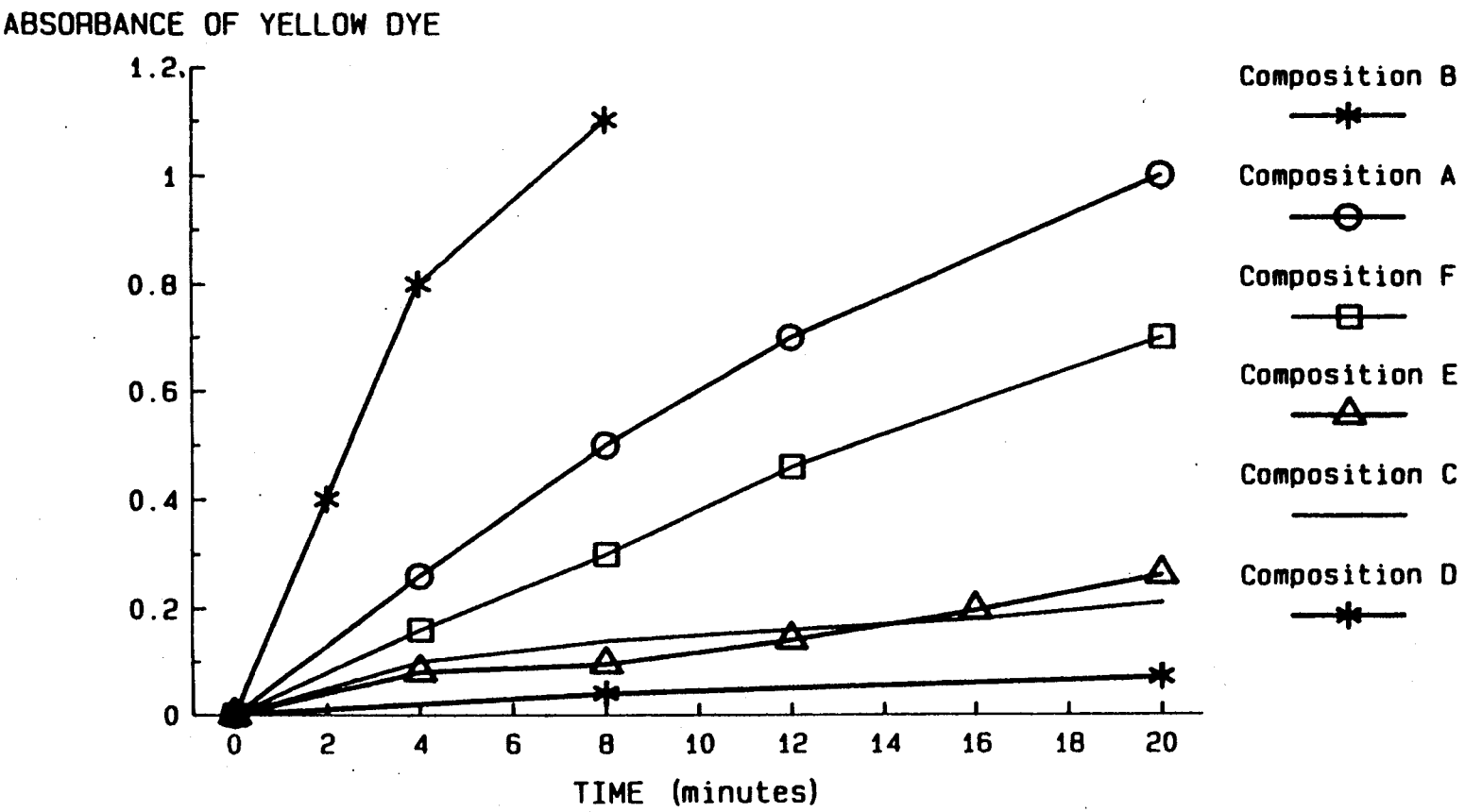
FIG. 4 is a graph comparing dissolution rates of various compressed polymer compositions at 110° F. in a beaker.
Figure 5:
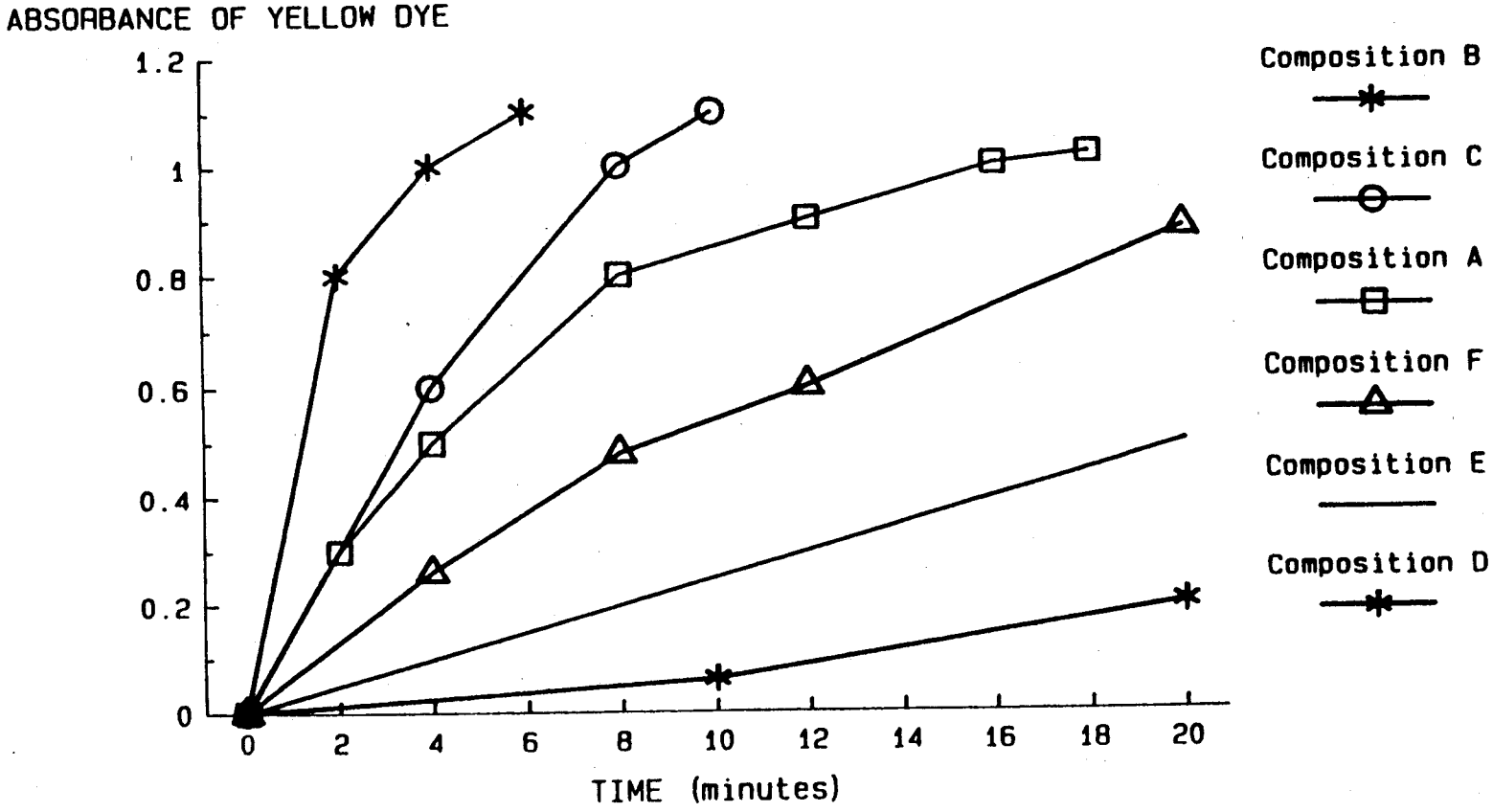
FIG. 5 is a graph comparing dissolution rates of various compressed polymer compositions at 140° F. in a beaker.

The results that were obtained are illustrated by FIG. 4 and FIG. 5 (110° F. and 140° F.). It can be seen that the Composition B tablet was the quickest dissolving polymer tested, fully dissolving within four minutes at 140° F. Composition F tablet exhibited a constant rate and decomposed completely by 18 minutes at 140° F.

II. Disintegration of a Polymer Tablet in a Dishwashing Machine

Each polymer composition listed in Table 1 was mixed with 0.4% by weight of the tablet of yellow dye (Acid Yellow #17) and the resulting mixture was tableted under a pressure of 6852 kg/cm$^2$ to form polymer tablets having a diameter of 13 mm, a thickness of 3.66 mm and a weight of 1.0 gram.

The disintegration of the polymers was tested directly in a dishwashing machine (Kitchen Aid ®).

The polymer tablet was placed on the bottom of the dishwashing machine. A light wash was begun simultaneously with the starting of a timer. Water temperature was maintained at 130° F. The tablets were evaluated as to the amount of polymer dissolved at time=3.00, 6.00, 9.00, 12.0, 15.0, 18.0 and 21.0 minutes. The experiment ended at 21 minutes or upon total disintegration of the tablet, whichever occurred first.

Figure 6:
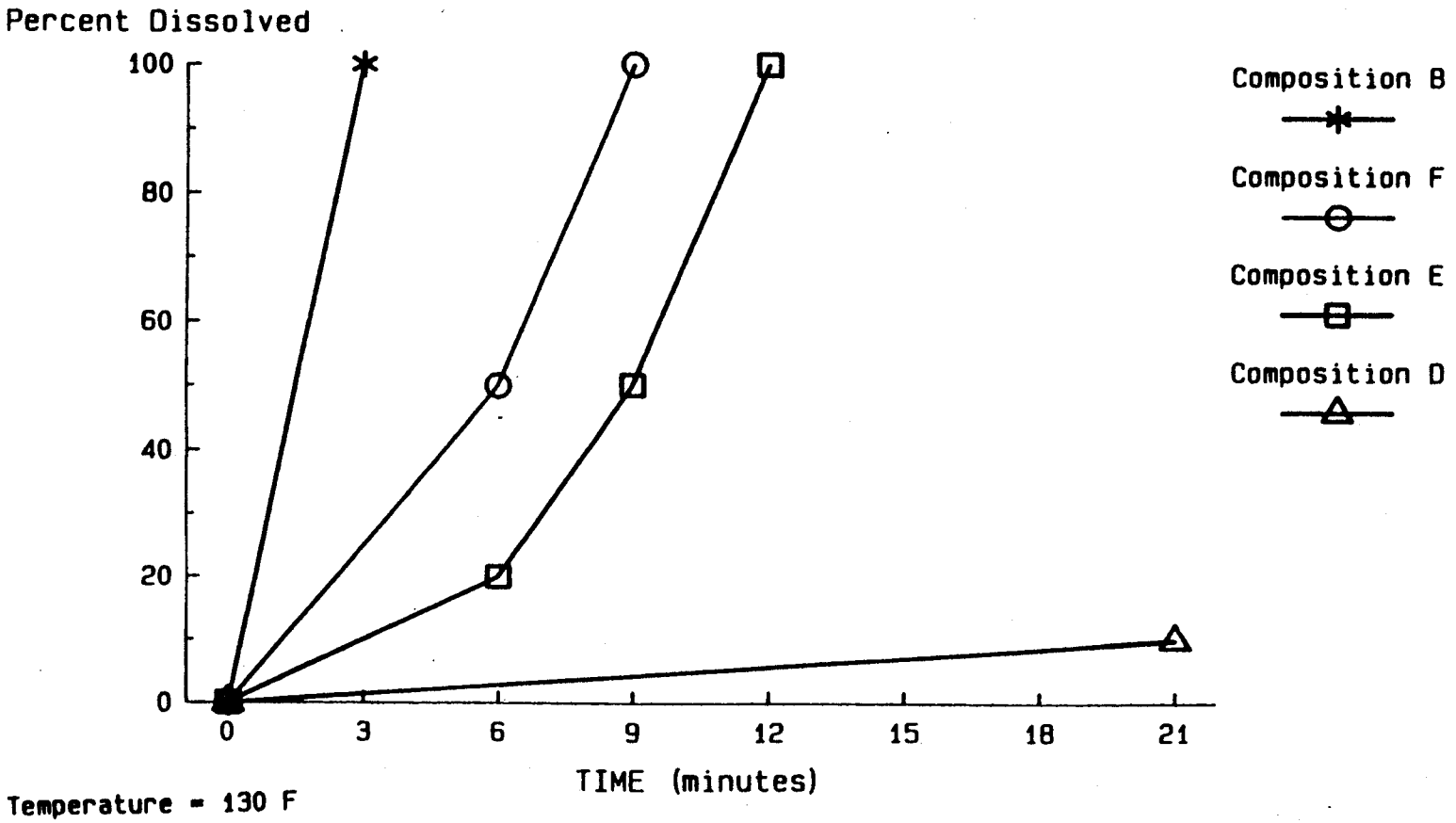
FIG. 6 is a graph comparing dissolution rates of various compressed polymer compositions at 130° F. in a dishwashing machine.

The results that were obtained are illustrated by FIG. 6.

It can be seen that the Composition B tablet had totally decomposed by the end of 3 minutes. Disintegration of the Composition F tablet took almost 9 minutes while the Composition D tablet had not decomposed more than 10% by the end of 21 minutes.

This Example illustrates that in order to choose ingredients suitable for the present invention the ingredients may be prescreened by conducting disintegration tests on polymer tablets in a beaker and/or in a dishwashing machine. It can be seen that the disintegration rate of the polymer mixtures may vary somewhat at different temperatures depending on the particular polymer employed.

Part I of this Example (FIG. 4 and 5) also demonstrates that the Composition B polymer is a particularly suitable polymer mixture to be employed in the tablet of the present invention when the time interval between the dissolution of the outer layer and the inner layer is relatively short, and Composition F polymer is a particularly suitable polymer mixture when the time interval between the dissolution of the outer layer and the inner layer is relatively long.

Part II of this Example (FIG. 6) illustrates that all tested tablets disintegrated faster in a dishwashing machine than in the beaker. Still, it can be seen that the Composition B polymer tablet disintegrated faster than the Composition F polymer tablet.

EXAMPLE 2

Preparation of a Tablet Containing a Chlorine Bleach and an Enzyme

The tablet was formed by using SPEX 3624B-115 X-Press motorized hydraulic press (35 ton) and SPEACAC stainless steel evacuable pellet dies (sizes 10, 13 and 31 mm).

1) One gram of an active chlorine bleach compound (Na-dichloroisocyanurate) was added to a 10 mm pellet die. This die was compressed under a pressure of 5775 kg/cm$^2$ to obtain an inner layer of about 4.5 mm thickness.

2) 0.45 gram Sokolan CP5 and 0.45 gram PEG 8000 (polyethylene glycol) were mixed to obtain a polymer mixture having Composition B (Table 1).

3) 0.5 grams of the polymer mixture was placed into a 13 mm pellet die. The bleach inner layer was centered directly on top of the polymer mixture. An additional 0.4 grams of the polymer mixture were placed over the bleach inner layer. The 13 mm die was then compressed under a pressure of 6852 kg/cm$^2$ to give an intermediate tablet, composed of the inner layer and the barrier layer, of about 7.5 mm thickness.

4) The following mixture was prepared (all percentages are by weight of the mixture):

Outer Layer Mixture (% by weight of the mixture):

35% Sodium Tripolyphosphate
14% Sodium Carbonate
20% Sodium Silicate (H24)
5% Sokolan CP5
3% Nonionic Surfactant
13% Sodium Citrate
2% α-Amylase
2% Protease
to 100% Water 5) 12 grams of the mixture prepared in step (4) were placed in 31 mm die. The intermediate tablet obtained in step (3) was centered directly on top of the mixture. Additional 11 grams of the mixture prepared in step (4) were placed over the intermediate tablet. The 31 mm die was then compressed under a pressure of 1200 kg/cm$^2$ to obtain the tablet of the invention. The tablet had a thickness of 19 mm, a diameter of 31 mm and a weight of 24.9 grams.

EXAMPLE 3

Preparation of a Tablet Containing a Dishwashing Detergent and a Rinse Aid

Two tablets are prepared following the procedure outlined in Example 2, except different ingredients are used to make the inner layer, the barrier layer and the outer layer.

The composition of two tablets of this Example varies only in composition of the outer layer. The composition is as follows:

Inner Core: 0.80 gram Citric Acid and 0.20 gram Nonionic Surfactant.

Polymer Mixture for a Barrier Layer: 0.77 gram Sokalan CP5 and 0.13 gram EMA (6:1 wt. ratio).

Composition F from Table 1

Outer Layer of Tablet 1:

A mixture containing by weight percent of the mixture:

| | |
|---|---|
| 33.0% | Na Tripolyphosphate |

-continued

| | |
|---|---|
| 11.0% | Na Carbonate |
| 20.0% | Na Silicate (H24) |
| 4.0% | Sokalan CP5 |
| 3.0% | Nonionic Surfactant |
| 17.0% | Perborate |
| 2.5% | TAED bleach activator |
| 2.0% | α-Amylase |
| 2.0% | Protease |
| to 100 | Water |
| 23 grams | Total |

Outer Layer of Tablet 2:

A mixture containing by weight percent of the mixture:

| | |
|---|---|
| 35.0% | Na Tripolyphosphate |
| 11.5% | Na Carbonate |
| 29.0% | Na Silicate (H24) |
| 8.0% | Sokalan CP5 |
| 4.5% | Nonionic Surfactant |
| 6.0% | CDB-56 |
| to 100 | Water |
| 23 grams | Total |

EXAMPLE 4

Preparation of a Tablet Containing a Dishwashing Detergent and A Rinse Aid

| Composition | % by Weight | Weight (grams) (of the layer) |
|---|---|---|
| a. Inner Layer | | |
| Citric acid | 80.0 | |
| SLF-18 nonionic surfactant | 20.0 | 0.75 |
| Total weight = 3.76 grams | | |
| b. Barrier Layer | | |
| Na-polyacrylate | 85.7 | 2.56 |
| Ethylene maleic anhydride | 14.3 | 0.43 |
| Total weight = 2.99 grams | | |
| c. Outer Layer | | |
| Na-triphosphate | 35.0 | 6.30 |
| Na-carbonate | 11.5 | 2.07 |
| Na-silicate | 29.0 | 5.22 |
| Na-polyacrylate | 8.0 | 1.44 |
| SLF-18 nonionic surfactant | 4.5 | 0.81 |
| Na-dichloroisocyanurate | 6.0 | 1.08 |
| Water | 6.0 | 1.08 |
| Total weight = 18.0 grams | | |

Processing

I. PREPARATION OF THE INNER LAYER MIXTURE

A. Incorporating a liquid surfactant i. Heat the surfactant if necessary, to lower the viscosity. (If SLF-18 is used the surfactant needs to be heated to about 140° F.)

ii. Add citric acid (80% by wt.) to a granulator. The granulator may be any type of granulating unit, such as a horizontal mixer, a rolling drum, a laboratory O'Brian unit, etc. The acid is stirred at about 70 rpm.

iii. Spray the surfactant onto the citric acid. blower.

v. Continue mixing until dry (about 15 minutes for 100 pound batch).

B. Incorporating a solid surfactant (either powder or granule):

A solid surfactant may be used by itself. Alternatively, a mixture of the solid surfactant and another ingredient such as hydroxycarboxylic acid may be prepared. When the mixture is prepared, ideally both ingredients are the same size to decrease segregation.

The mixture may be prepared as follows:

i. Add citric acid and the solid surfactant to a mixer. Any mixer such as a Schugi mixer, rolling drum, V blender is suitable.

ii. Mix until uniform (about 10 minutes for 100 pound batch).

Tablet Preparation 3.76 grams of the inner layer (rinse aid) is added to a 16 mm pellet die. This die is compressed under a pressure of 2260 kg/cm$^2$ to give a tablet of about 11 mm thickness to obtain a rinse aid tablet. 1.66 grams of Composition F (from Table 1) is placed into a 19 mm pellet die. The rinse aid tablet is centered directly on top of the polymer mixture. An additional 1.33 grams of the polymer mixture is placed over the rinse aid tablet. The 19 mm die is then compressed under a pressure of 3200 kg/cm$^2$ to give an intermediate tablet of about 14 mm thickness. 9.4 grams of the outer layer mixture is introduced into a 31 mm die. The intermediate tablet is centered directly on top of the alkaline detergent mixture. An additional 8.6 grams of this mixture is placed over the intermediate tablet. The die is then compressed under a pressure of 1200 kg/cm$^2$ to give a tablet having a thickness of about 19 mm and a diameter of about 31 mm.

EXAMPLE 5

The performance of the tablet of the present invention prepared in Example 2 (composition 3) was compared with the performance of the tablet (composition 2) which is not within the scope of the present invention and with the performance of a commercial granular dishwashing detergent (composition 1). The composition 2 tablet lacked a barrier layer; the tablet, however, did include an enzyme and a source of chlorine bleach. Commercial granular dishwashing detergent included a source of chlorine bleach but lacked an enzyme. Same amount of dishware was used in washing with composition 1, 2 or 3. Wash conditions were: 135° F. and tap water (about 120 ppm hardness). Soil conditions were: approximately 0.75 cream of wheat per plate applied by spray gun, stored overnight at room temperature/humidity.

Compositions 1, 2, and 3 were as summarized in Table 2. The compositions were used by adding the composition to the wash liquor at the time when the dispenser cup opened (i.e., one to two minutes after the start of the main wash).

TABLE 2

DIFFERENT COMPOSITIONS OF AUTODISH DETERGENT IN % BY WEIGHT

| 1 | 2 (Mixed | 3 (Sequential Release Tablet) (% by weight of the |
|---|---|---|

TABLE 2-continued

| COMPOSITION | (Granular Form) | Tablet) | layer) |
|---|---|---|---|
| a. Outer Layer | | | |
| Na-triphosphate | 31.5 | 33 | 35.0 |
| Na-carbonate | 23.4 | 13 | 14.0 |
| Na-silicate | 7.8 | 19 | 20.0 |
| Na-sulfate | 22.2 | — | — |
| Na-dichloroisocyanurate dihydrate | 1.7 | 4.0 | — |
| Condensate of ethylene oxide and propylene oxide straight chain fatty alcohol | 3.0 | — | — |
| Na-polyacrylate (Sokalan CP-5) | — | 6.45 | 5.0 |
| Na-citrate | — | 12.5 | 13.0 |
| α-amylase | — | 1.9 | 2.0 |
| Protease | — | 1.9 | 2.0 |
| SLF-18 nonionic surfactant | — | 2.75 | 3.0 |
| Water | 10.7 | 5.5 | 6.0 |
| Weight (grams) | 30.0 | 24.9 | 23.0 |
| Pressure (kg/cm$^2$) | — | 1200 | 1200 |

| COMPOSITION | 3 (Granular Form) | 4 (Mixed Tablet) | 5 (Sequential Release Tablet) (% by weight of the layer) |
|---|---|---|---|
| b. Barrier Layer | | | |
| Na-polyacrylate (Sokalan CP-5) | — | — | 50.0 |
| Polyethylene glycol | — | — | 50.0 |
| Weight (grams) | — | — | 0.9 |
| Pressure (kg/cm$^2$) | — | — | 6852 |
| c. Inner Layer | | | |
| Na-dichloroisocyanurate dihydrate | | | 100 |
| Weight (grams) | | | 1.0 |
| Pressure (kg/cm$^2$) | | | 5775 |
| Density (g/cm$^3$) | 0.9 | 1.7 | 1.7 |
| Amount of starch soil remaining (%) | 88.3 | 25.6 | 5.1 |
| Glass Appearance Spotting/filming 0/0 = no spots/no film 4/5 = glasses completely covered/chalky | 0.5/1.0 | 0.5/1.5 | 0.5/1.5 |

Figure 7:
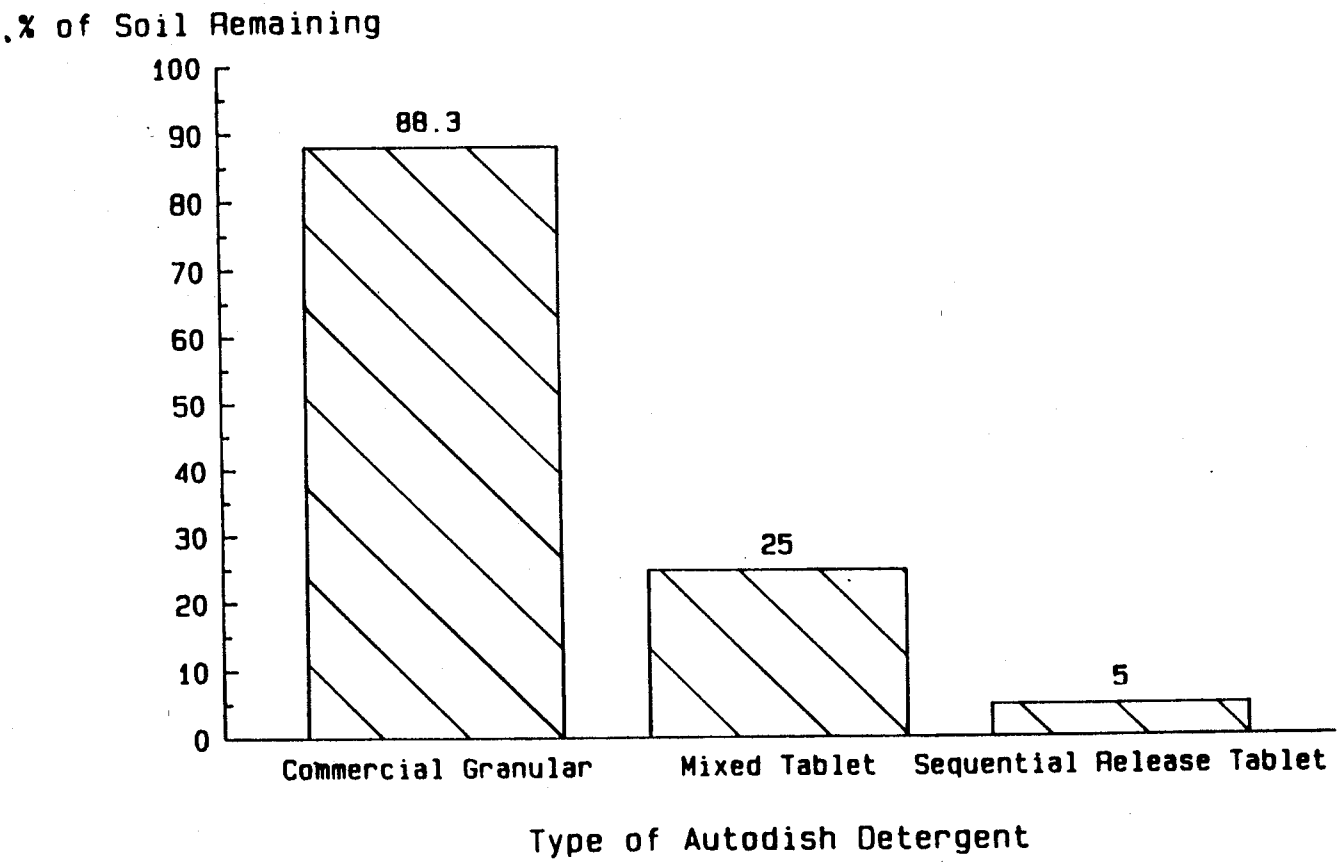
FIG. 7 is a bar graph illustrating improved starch soil removal accomplished by a preferred tablet of the invention containing an enzyme and a source of chlorine bleach, compared to starch soil removal of a commercial granular dishwashing detergent lacking an enzyme and to starch soil removal of a tablet not capable of sequential release.

Starch soil removal accomplished by compositions 1, 2 and 3 is illustrated by FIG. 7.

This Example demonstrates that although it is not within the scope of the present invention, the tablet containing enzymes and chlorine (Composition 2) removes a greater amount of starch soil than the granular autodish detergent (Composition 1) lacking enzymes. Even more importantly, the sequential release tablet according to the present invention (Composition 3) removes a substantially larger amount of starch soil than either Composition 1 or Composition 2 which are not within the scope of the present invention.

Excellent performance of the composition 3 tablet of the present invention in cleaning dishware so effectively is due to the ability of the tablet to release sequentially the enzyme and the chlorine bleach, so that the dissolution of the chlorine bleach is separated in time from the dissolution of the enzyme.

Spotting and filming tests were conducted according to the test procedure as described in the 1989 Annual Book of ASTM Standards, vol. 15.04, Test D3556 - 85. Slightly better filming scores were obtained for Composition 1, which may be due to the composition's higher solubility.

The trademarks and the suppliers of the ingredients utilized in the Examples of this description are as follows:

| Ingredient | Trademark | Supplier |
|---|---|---|
| Sodium Tripolyphosphate | STPP | Monsanto Corp. |
| Nonionic surfactant | SLF-18 | Olin Corp. |
| Na-Dichloroisocyanurate dihydrate | CDB-56 | Olin Corp. |
| Sodium citrate | Sodium citrate | Miles, Inc. |
| Protease A/S | Savinase | Novo Industri A/S |
| Amylase | Termamyl 60T | Novo Industri A/S |
| Sodium silicate 2:1 | Britesil H20 | PQ Corp. |
| Sodium silicate 2:4 | Britesil H24 | PQ Corp. |
| Sodium Carbonate | | FMC Corp. |
| Citric acid | | Miles, Inc. |
| Maleic acid/Acrylic acid copolymer, sodium salt (MW = 70,000) | Sokalan CP5 | BASF |
| Ethylene Maleic Anhydride cross-linked copolymer (MW = 1,000,000) | EMA-61 | Monsanto |
| Polyethylene Glycol (MW = 7,000–9,000) | PEG 8000 | Union Carbide |

Unless otherwise indicated all percentages are by weight of the tablet.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A machine dishwashing detergent tablet comprising a) an inner layer comprising a source of chlorine bleach in an amount which corresponds to from about 0.1% to about 20% of available chlorine;

b) a barrier layer surrounding the inner layer, the barrier layer comprising an ingredient selected from the group consisting of a water-soluble polymer a water-swellable polymer, a mixture of water-soluble polymers, a mixture of water-swellable polymers, a fatty acid, a soap, a wax, and mixtures thereof;

c) an outer layer surrounding the barrier layer, the outer layer comprising from about 0.05% to about 20% of an enzyme;

wherein the total amount of ingredients in the inner layer, the barrier layer and the outer layer is such that the tablet comprises A) about 10% to about 99% of a builder, and B) an amount of an alkaline source sufficient to provide a pH of a 0.1% solution by weight of the tablet of greater than 9.0 during a dishwashing cycle of a dishwashing machine;

and wherein the disintegration rate of the barrier layer at a temperature in the range of from about 100° F. to about 160° F. in an aqueous cleaning environment of a dishwashing machine, and the relative thicknesses of the inner layer, the barrier layer and the outer layer are such that:

(i) at water temperature in a range from about 100° F. to about 160° F., in the aqueous cleaning environment of the dishwashing machine, from about 1 to about 20 minutes is afforded prior to release of the inner layer ingredient, and (ii) all layers of the tablet disintegrate in the aqueous cleaning environment of the dishwashing machine by the end of a dishwashing session.

2. The tablet of claim 1 wherein the source of chlorine bleach is selected from the group consisting of alkali metal hypochlorites, chlorinated trisodium phosphate, chlorinated sulphonamides, chlorinated hydantoins, chlorinated cyanuric acids, salts of chlorinated cyanuric acids, polychlorocyanurate and mixtures thereof.

3. The tablet of claim 1 wherein the enzyme is selected from the group consisting of lipases, amylases, proteases, and mixtures thereof.

4. The tablet of claim 1 wherein the tablet further comprises a detergent active compound in an amount of about 0.05% to about 15%.

5. The tablet of claim 1 wherein the table further comprises a source of oxygen bleach in an amount corresponding to from about 0.05% to about 10% of available oxygen.

6. The tablet of claim 1 wherein the tablet is of a cylindrical shape and the diameter of the tablet is about 26 mm to about 36 mm, and the thickness of the tablet is about 14 mm to about 24 mm.

7. The tablet of claim 1 wherein the thickness of the inner layer is about 3 mm to about 6 mm, and the total thickness of the barrier layer and the inner layer is about 6 mm to about 9 mm.

8. The tablet of claim 1 wherein the barrier layer contains a plasticizer.

9. The tablet of claim 1 wherein the water-soluble or water-swellable polymer of the barrier layer is selected from the group consisting of a maleic acid/acrylic acid copolymer, a salt of maleic acid/acrylic acid copolymer, ethylene maleic anhydride cross-linked copolymer, polyethylene glycol, polyvinyl pyrrolidone, an acrylic acid polymer, a salt of acrylic acid polymer, carboxymethylcellulose, polyvinylalcohol, cellulose ether and mixtures thereof.

10. The tablet of claim 9 wherein the polymer is a mixture of a polyacrylic acid/maleic acid copolymer and polyethylene glycol.

11. The tablet of claim 10 wherein the weight ratio of polyacrylic acid/maleic acid copolymer to polyethylene glycol is about 1:3 to about 3:1.

12. The tablet of claim 1 wherein the outer layer comprises about 10% to about 99% of a builder and from 0.05% to 15% of a detergent-active material.

13. The tablet of claim 1 wherein the builder is selected from the group consisting of alkali metal ortho-, pyro and tripolyphosphates and hexametaphosphates, silicates, carbonates, zeolites, borates, citrates, oxydisuccinates, carboxymethyloxysuccinates, nitrilotriacetates, citrates and ethylenediaine-tetraacetates, polyelectrolytes, polymaleates, polyaeter and mixtures thereof.

14. A machine dishwashing detergent tablet comprising a) an inner layer comprising an ingredient selected from the group consisting of a nonionic surfactant and a mixture of the nonionic surfactant with hydroxycarboxylic acid;

b) a barrier layer surrounding the inner layer, the barrier layer comprising an ingredient selected from the group consisting of a water soluble polymer a water-swellable polymer, a mixture of water soluble polymers, a mixture of water-swellable polymers, a fatty acid, a soap, a wax, and mixtures thereof; and c) an outer layer surrounding the barrier layer, the outer layer comprising a builder and an ingredient selected from the group consisting of about 0.05% to about 20% of an enzyme, a source of chlorine bleach in an amount which corresponds to from about 0.1% to about 20% of available chlorine, wherein the total amount of ingredients in the barrier layer and the outer layer is such that the tablet comprises A) about 10% to about 99% of a builder, and B) an amount of an alkaline source sufficient to provide a pH of a 0.1% solution by weight of the tablet of greater than 9.0 during a dishwashing cycle of a dishwashing machine;

and wherein the disintegration rate of the barrier layer at a temperature in the range of from about 100° F. to about 160° F. in an aqueous cleaning environment of a dishwashing machine, and the relative thicknesses of the inner layer, the barrier layer and the outer layer are such that:

(i) at water temperature in a range from about 100° F. to about 160° F., in the aqueous cleaning environment of the dishwashing machine, from about 6 to about 44 minutes is afforded prior to release of the ingredient of the inner layer, and (ii) all layers of the tablet disintegrate in the aqueous cleaning environment of the dishwashing machine by the end of a dishwashing session.

15. The tablet of claim 14 wherein the amount of the nonionic surfactant in the inner layer is about 1% to about 100% by weight of the inner layer.

16. The tablet of claim 14 wherein the outer layer comprises about 10% to about 99% of the builder, and further comprises a source of chlorine bleach in an amount corresponding to from about 0.1% to about 20% of available chlorine.

17. The tablet of claim 14 wherein the outer layer comprises about 10% to about 99% of the builder and about 0.05% to about 20% of the enzyme.

18. The tablet of claim 14 wherein the tablet is of a cylindrical shape and the diameter of the tablet is about 26 mm to about 36 mm, and the thickness of the tablet is about 16 m to about 22 mm.

19. The tablet of claim 14 wherein the thickness of the inner layer is about 9 mm to about 13 mm, and the total thickness of the barrier layer and the inner layer is about 12 mm to about 16 mm.

20. The tablet of claim 14 wherein the water-soluble or the water-swellable polymer is selected from the group consisting of a maleic acid/acrylic acid copolymer, a salt of maleic acid/acrylic acid copolymer, ethylene maleic anhydride cross-linked copolymer, polyethylene glycol, polyvinyl pyrrolidone, an acrylic acid polymer, a salt of acrylic acid polymer, carboxymethylcellulose, polyvinylalcohol, cellulose ether and mixtures thereof.

21. The tablet of claim 20 wherein the polymer of the barrier layer is a mixture of polyacrylic acid/maleic acid copolymer and ethylene maleic anhydride.

22. The tablet of claim 21 wherein the weight ratio of polyacrylic acid/maleic acid copolymer to ethylene maleic anhydride is about 2:1 to about 10:1.

23. A method of dishwashing comprising placing the tablet of claim 1 in a dishwashing machine.

24. The method of claim 23 wherein the tablet of claim 1 is placed in a dispenser of a dishwashing machine.

25. A method of dishwashing comprising placing the first tablet of claim 1 in a prewash detergent dispenser of a dishwashing machine and the second tablet of claim 1 in a main wash dispenser of a dishwashing machine.

26. A method of dishwashing comprising placing the tablet of claim 1 in a prewash detergent dispenser of a dishwashing machine.

27. The method of claim 26 further comprising placing the tablet of claim 14 in a main wash dispenser of a dishwashing machine.

28. The tablet of claim 1, wherein in a dishwashing machine at a wash liquor temperature of from about 100° F. to about 160° F. the outer layer of the tablet dissolves within the first 0.5 to 5 minutes and the barrier layer disintegrates within the next 0.5 to 15 minutes.

29. The tablet of claim 1, wherein the total number of the layers in the tablet is three.

* * * * *